US010905302B2

(12) United States Patent
Moon et al.

(10) Patent No.: US 10,905,302 B2
(45) Date of Patent: Feb. 2, 2021

(54) CLEANER

(71) Applicant: LG ELECTRONICS INC., Seoul (KR)

(72) Inventors: Sihwan Moon, Seoul (KR); Jihoon Sung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 313 days.

(21) Appl. No.: 15/857,469

(22) Filed: Dec. 28, 2017

(65) Prior Publication Data

US 2018/0184870 A1 Jul. 5, 2018

(30) Foreign Application Priority Data

Dec. 30, 2016 (KR) ..... 10-2016-0184445

(51) Int. Cl.
*A47L 11/18* (2006.01)
*A47L 13/22* (2006.01)
(Continued)

(52) U.S. Cl.
CPC ..... *A47L 11/185* (2013.01); *A47L 11/282* (2013.01); *A47L 11/408* (2013.01);
(Continued)

(58) Field of Classification Search
CPC ..... A47L 2201/04; A47L 2201/06; A47L 2201/00; A47L 2201/026; A47L 9/0466;
(Continued)

(56) References Cited

U.S. PATENT DOCUMENTS 7,322,070 B2 * 1/2008 Zimmerle ..... A47L 5/225 15/315
8,596,898 B2 * 12/2013 Walcot ..... C09D 7/44 401/218

(Continued)

FOREIGN PATENT DOCUMENTS

CN 203619483 U 6/2014
CN 04026624 U 12/2014

(Continued)

OTHER PUBLICATIONS

Oh Jae Wook, "Wet Cleaning Structure of Robot Cleaner", 2009, translation, KR100887891 (Year: 2009).*

(Continued)

*Primary Examiner* — Orlando E Aviles
*Assistant Examiner* — Robert F Neibaur
(74) *Attorney, Agent, or Firm* — Ked & Associates, LLP

(57) ABSTRACT

The present invention provides a cleaner including a cleaner main body having a controller, a support member detachably coupled to a module mounting portion of the cleaner main body, and a mop module rotatably supported on the support member, wherein the mop module includes a rotating rod configured to be rotatable in at least one direction by being interlocked with a rotation driving portion provided in the module mounting portion when the supporting member is mounted on the module mounting portion, and a mop member formed to surround an outer circumference of the rotating rod so as to mop the floor in response to the rotation of the rotating rod.

20 Claims, 12 Drawing Sheets

(51) Int. Cl.
*A47L 11/282* (2006.01)
*A47L 11/40* (2006.01)

(52) U.S. Cl.
CPC ..... *A47L 11/4041* (2013.01); *A47L 13/22* (2013.01); *A47L 2201/04* (2013.01); *A47L 2201/06* (2013.01)

(58) Field of Classification Search
CPC .... A47L 9/2805; A47L 9/2847; A47L 11/145; A47L 11/164; A47L 11/08; A47L 11/085; A47L 11/185; A47L 11/4041; A47L 11/408; A47L 11/18; A47L 11/14; A47L 11/10; A47L 11/02; A47L 11/00; A47L 11/20; A47L 11/302; A47L 11/292; A47L 11/4083; B05C 1/0808; B05C 1/0813
USPC ..... 15/98, 97.1, 49.1, 52, 320, 319, 53.3, 15/52.1, 103.5, 230; 401/197
See application file for complete search history.

(56) References Cited

U.S. PATENT DOCUMENTS

| | | | | |
|---|---|---|---|---|
| 8,670,866 | B2 * | 3/2014 | Ziegler | A47L 5/14 700/245 |
| 8,898,844 | B1 | 12/2014 | Dooley et al. | |
| 9,833,116 | B2 * | 12/2017 | Huang | A47L 9/2857 |
| 10,427,085 | B2 * | 10/2019 | Kim | A47L 9/2805 |
| 2016/0051108 | A1 | 2/2016 | Huang et al. | |
| 2016/0128532 | A1 | 5/2016 | Babenhauserheide et al. | |
| 2016/0150934 | A1 | 6/2016 | Kim et al. | |

FOREIGN PATENT DOCUMENTS

| | | |
|---|---|---|
| DE | 10 2014 116 375 | 10/2015 |
| EP | 3 031 376 | 6/2016 |
| JP | 4196087 | 12/2008 |
| KR | 10-2006-0062990 | 6/2006 |
| KR | 10-2007-0016543 | 2/2007 |
| KR | 10-0887891 | 3/2009 |
| KR | 10-2012-0129185 | 11/2012 |
| KR | 10-2015-0143208 | 12/2015 |
| KR | 10-1578887 | 12/2015 |
| KR | 10-2016-0066399 | 6/2016 |

OTHER PUBLICATIONS

Van Teeffelen Niklas, Cleaning Device With a Cleaning Roller That Can Be Rotated About an Axis of Rotation, Dec. 29, 2016 , (Year: 2016).*

Taiwanese Office Action issued in Application 106144877 dated Dec. 22, 2018 (full Chinese text and English translation).

European Search Report dated Jul. 8, 2020 issued in EP Application No. 17888513.3.

* cited by examiner

CLEANER

CROSS-REFERENCE TO RELATED APPLICATION

Pursuant to 35 USC § 119 (a), this application claims the benefit of an earlier filing date and priority to Korean Application No. 10-2016-0184445, filed on Dec. 30, 2016, the contents of which are incorporated by reference herein in its entirety.

1. FIELD OF THE INVENTION

The present invention relates to a cleaner in which a mop module is detachably coupled to a cleaner main body.

2. BACKGROUND OF THE INVENTION

A cleaner is a device that performs a vacuum cleaning function for collecting dust and foreign substances from sucked air, or a mop cleaning function of performing mopping. A cleaner that performs the mop cleaning function has not been widely researched and developed as compared to a cleaner performing the vacuum cleaning function.

Regarding the mop cleaning function, U.S. Pat. No. 8,898,844 B1 (Dec. 2, 2014) discloses a cleaner in which a mop assembly is disposed on a lower portion of a cleaner main body to mop a floor in response to movement of the cleaner main body. In this patent, water is filled in the mop assembly through a water inlet formed through an upper portion of the mop assembly, and discharged little by little through a wick provided on a lower portion of the mop assembly.

In this structure, since the mop assembly is configured to mop the floor merely by a weight of the cleaner main body and the movement of the cleaner main body, it has a limit on mopping performance.

Further, since the wick through which the water is discharged is provided on the lower portion of the mop assembly, water is continuously discharged through the wick to wet the floor even while the cleaner is turned off.

In addition, since the water inlet and the wick are located on the upper and lower portions of the mop assembly, that is, at opposite sides to each other, water is discharged through the wick on the opposite side when water is refilled through the water inlet.

In recent years, a cleaner having both the vacuum cleaning function and the mop cleaning function has been developed. In such a cleaner, the user may detachably couple a brush assemble or a mop assembly to the cleaner main body for use according to a type of cleaning to be performed. However, a cleaning mode of the cleaner has not been changed in cooperation with a mounted assembly.

SUMMARY OF THE INVENTION

A first aspect of the present invention is to provide a cleaner having a mop module, capable of mopping a floor not only by movement of a cleaner main body but also by its own rotation.

A second aspect of the present invention is to provide a cleaner, in which water is not discharged through a water outlet when the cleaner is turned off.

A third aspect of the present invention is to provide a cleaner, capable of preventing a discharge of water through a water outlet while refilling water in a mop module.

A fourth aspect of the present invention is to provide a cleaner, capable of automatically recognizing a mounted state of a brush module or a mop module.

In order to accomplish the first aspect, a cleaner of the present invention may include a cleaner main body having a controller, a support member (or support frame) detachably coupled to a module mounting portion (or module mounting recess) of the cleaner main body, and a mop module rotatably supported on the support member. The mop module may include a rotating rod configured to be rotatable in at least one direction by being interlocked with a rotation driving portion provided in the module mounting recess when the support frame is mounted on the module mounting portion, and a mop member (or mop cover) formed to surround an outer circumference of the rotating rod so as to mop the floor in response to the rotation of the rotating rod.

The rotating rod may be provided with a water receiving portion formed therein, and a water outlet formed through the outer circumference of the rotating rod to communicate with the water receiving portion.

The water outlet may have a preset size such that water filled in the water receiving portion is discharged therethrough by centrifugal force only when the rotating rod rotates.

The support member may include a first support portion and a second support portion to rotatably support both end portions of the rotating rod, and a first connection portion and a second connection portion arranged to be spaced apart from each other to connect the first support portion and the second support portion, and a part of the mop module may be disposed to protrude into a space between the first connection portion and the second connection portion spaced apart from each other.

A rotation coupling portion detachably coupled to the rotation driving portion may be provided on one end portion of the rotating rod penetrating through the first support portion, and a rotation support portion rotatably supported by the second support portion may be provided on another end portion of the rotating rod.

The cleaner main body may be provided with a driving wheel operated under the control of the controller.

The cleaner main body may include a main housing having a circuit board constituting the controller mounted therein, and a module mounting housing coupled to the main housing in a protruding manner and having the module mounting portion formed thereon.

The first aspect of the present invention may also be achieved by a cleaner including a cleaner main body having a controller and a module mounting portion, and a mop module detachably coupled to the cleaner main body, and the mop module may include a rotating rod configured to be rotatable in at least one direction with being interlocked with a rotation driving portion provided in the module mounting portion upon being mounted on the cleaner main body, the rotating rod provided with a water receiving portion therein, and a water outlet communicating with the water receiving portion, and a mop member provided to cover the water outlet by surrounding an outer circumference of the rotating rod, to mop a floor in response to rotation of the rotating rod.

In order to achieve the second aspect of the present invention, the outer circumference of the rotating rod may be divided into a first part having the water outlet and a second part without the water outlet along the circumference, and the controller may stop the rotation of the rotating rod in a state where the first part is positioned above the second part by using the sensing unit.

That is, the water outlet may be arranged to face an upper side of the cleaner in a state where the rotation of the rotating rod is stopped.

The sensing unit may include a permanent magnet mounted on the rotating rod, and a hall sensor installed on the module mounting portion to detect a change in magnetic force caused by the permanent magnet.

In order to achieve the third aspect of the present invention, a water inlet may be formed at the first part to communicate with the water receiving portion.

In order to achieve the fourth aspect of the present invention, a brush module may be detachably coupled to the module mounting portion in place of the mop module, and the brush module may sweep dust on the floor but may not be provided with a permanent magnet. The controller may activate a different cleaning mode depending on the detection or non-detection of the magnetic force by using the hall sensor.

The effects of the present invention obtained by the aforementioned solutions are as follows.

First, according to the present invention, the mop module may be mounted on the module mounting portion of the cleaner main body directly or with being rotatably supported by the support member, and configured to be rotatable by receiving driving force from the rotation driving portion. Therefore, a mop cleaning function can be implemented not only by movement of the cleaner main body but also by the rotation of the mop module. This may result in improving mop performance as compared with a mopping method of the related art cleaner.

Second, the controller may stop the rotation of the rotating rod in a state where the water outlet is arranged to face an upper side of the cleaner by using the sensing unit. Accordingly, while the cleaner is turned off, water is not discharged through the water outlet. This may result in solving a problem of wetting the floor due to leaked water even while the cleaner is turned off, which has occurred in the related art cleaner.

Third, the water inlet is formed adjacent to one side of the water outlet so as to face the same direction. Therefore, when the user intends to refill water in the water receiving portion, since the water outlet faces the same direction (i.e., the upper side) as the water inlet, the problem of the water leakage through the water outlet can be prevented.

Fourth, the permanent magnet is not mounted on the brush module. Accordingly, when the brush module is mounted, unlike the case where the mop module is mounted, magnetic force is not detected by the hall sensor. The controller can detect whether the mop module or the brush module has been mounted on the module mounting portion based on whether or not the magnetic force is detected by the hall sensor. In addition, the controller can activate a different cleaning mode depending on the detection or non-detection of the magnetic force by the hall sensor.

DETAILED DESCRIPTION OF THE PREFERRED EMBODIMENT

Hereinafter, a cleaner according to the present invention will be described in detail with reference to the accompanying drawings.

A singular representation may include a plural representation unless it represents a definitely different meaning from the context.

In describing the present disclosure, if a detailed explanation for a related known function or construction is considered to unnecessarily divert the gist of the present disclosure, such explanation has been omitted but would be understood by those skilled in the art.

The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Figure 1:
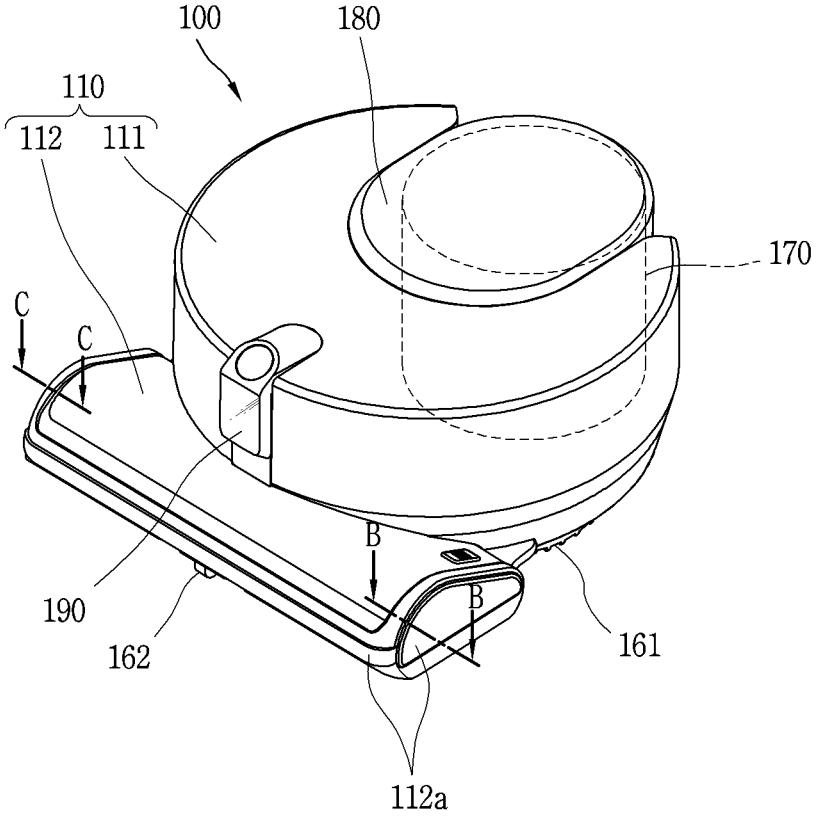
FIG. 1 is a perspective view illustrating one embodiment of a cleaner according to the present invention.
Figure 2:
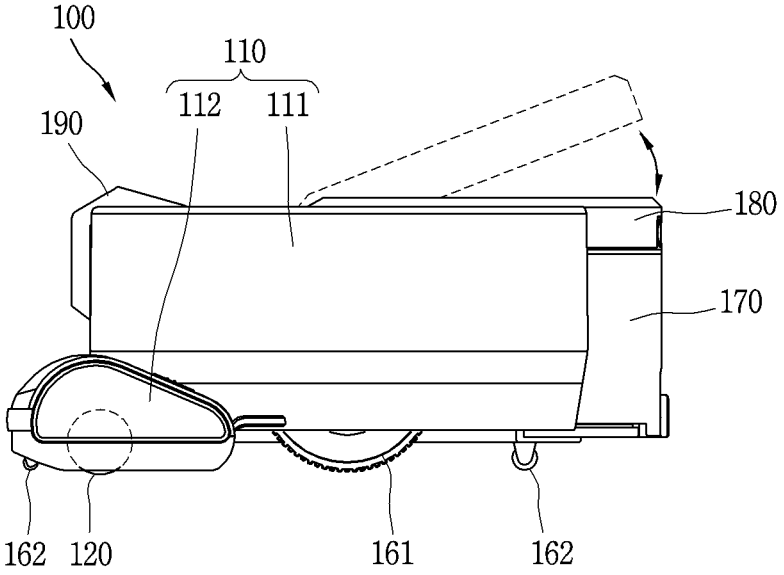
FIG. 2 is a lateral view of the cleaner illustrated in FIG. 1.
Figure 3:
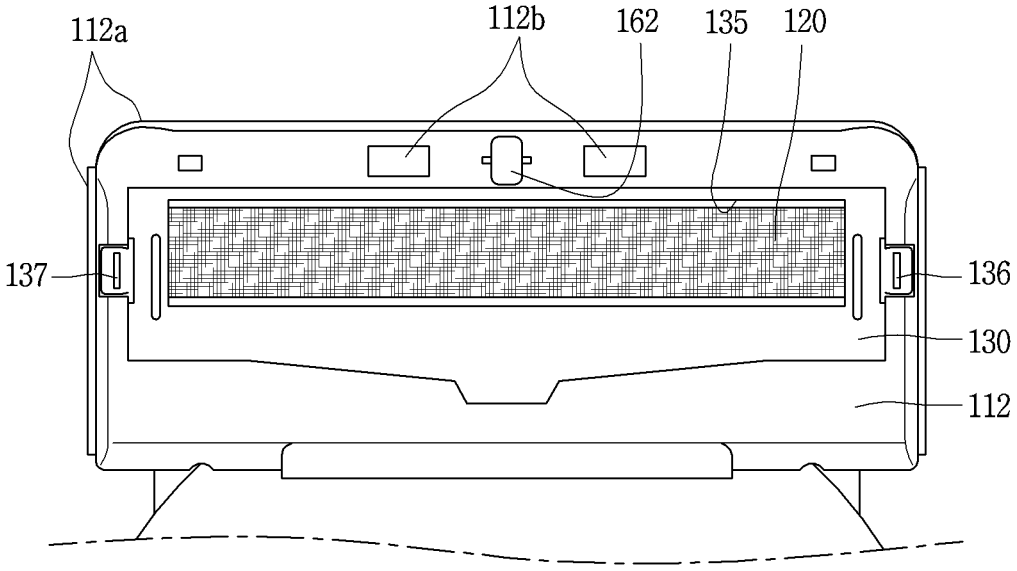
FIG. 3 is a conceptual view illustrating a lower portion of a cleaner main body illustrated in FIG. 1.

FIG. 1 is a perspective view illustrating one embodiment of a cleaner 100 according to the present invention, FIG. 2 is a lateral view of the cleaner 100 illustrated in FIG. 1, and FIG. 3 is a conceptual view illustrating a lower portion of a cleaner main body 110 illustrated in FIG. 1.

These drawings illustrate, as an example of the cleaner 100, a robot cleaner 100 that performs a function of mopping a floor while traveling by itself in a predetermined area. The cleaner 100 may be configured to perform not only such a mop cleaning function, but also a vacuum cleaning function of sucking air on a floor and separately collecting dust and foreign substances from the sucked air.

The cleaner 100 includes a cleaner main body 110 and a mop module 120.

The cleaner main body 110 defines appearance of the cleaner 100. The cleaner main body 110 is provided with various components in addition to a controller (not illustrated) for controlling the cleaner 100.

In these drawings, the cleaner main body 110 includes a main housing 111, and a module mounting housing 112 coupled to the main housing 111 in a protruding manner. A circuit board (not illustrated) constituting the controller is disposed in the main housing 111. A module mounting portion 110*a* to which various modules (for example, a mop module 120 and a brush module 150) are detachably coupled is formed on the module mounting housing 112.

However, the present invention is not limited thereto. The cleaner main body 110 may be configured only by the main housing 111. In this case, the module mounting portion 110*a* may be formed on the main housing 111.

The cleaner main body 110 may be provided with a bumper switch 112*a* for detecting a physical collision. The bumper switch 112*a* may include a bumper member 112*a*' moved inward by a physical collision with an obstacle, and a switch 112*a*" pressed when the bumper member 112*a*' is moved inward.

In these drawings, the bumper switch 112*a* is provided in the module mounting housing 112. The bumper switch 112*a* may be disposed on a front surface of the module mounting housing 112. In some cases, the bumper switch 112*a* may be disposed on each of both side surfaces of the module mounting housing 112 as well as the front surface.

The cleaner main body 110 is provided with driving wheels 161 for travel. The driving wheel may be provided on each of both left and right sides of the cleaner main body 110. The cleaner main body 110 may be moved or rotated forward, backward, or to the left or right by the driving wheel 161.

For example, when the cleaner 100 has an autonomous travel function like the robot cleaner 100, the wheel may be configured as a driving wheel 161 that is rotated by receiving driving force from a driving motor. In another example, when the cleaner main body 110 is moved by a user's operation, the wheel may be configured to have only a typical rolling function with respect to a floor.

The cleaner main body 110 may further include an auxiliary wheel 162. The auxiliary wheel 162 supports the cleaner main body 110 together with the driving wheel 161 and assists the travel of the cleaner 100 by the driving wheel 161.

As illustrated, when the module mounting housing 112 is disposed in a protruding form from the main housing 111, the auxiliary wheel 162 described above may also be provided on the module mounting housing 112 for stable running of the cleaner 100.

The cleaner main body 110 may be provided with a cliff sensor 112*b* for sensing a lower terrain. In these drawings, the cliff sensor 112*b* is disposed on a lower portion of the module mounting housing 112. The cliff sensor 112*b* may also be disposed on a lower portion of the main housing 111.

The cliff sensor 112*b* includes a light emitting portion and a light receiving portion, and is configured to measure a distance to the floor by measuring a time taken for light emitted from the light emitting portion to the floor to be received at the light receiving portion. Therefore, in case where a step that is sharply lowered is formed at the front, the reception time rapidly increases. When a cliff is present at the front, light is not received at the light receiving portion.

The controller is configured to control an operation of the driving wheel 161 when it is detected through the cliff sensor 112*b* that the lower terrain is lowered by a predetermined level or more. For example, the controller may apply a driving signal of an opposite direction to the driving wheel 161 so that the cleaner 100 travels in the opposite direction. Alternatively, the controller may apply a driving signal only to one driving wheel 161 or apply different driving signals to the left and right driving wheels 161, such that the cleaner 100 can be rotated.

The mop module 120 is a component for mopping the floor, and may be detachably coupled to the module mounting portion 110*a* of the cleaner main body 110. In these drawings, the mop module 120 is mounted on the module mounting portion 110*a* formed on the lower portion of the module mounting housing 112.

As will be described later, when the cleaner 100 is configured to suck dust and foreign substances on the floor, the cleaner 100 may be provided with a brush module 150 (see FIG. 12) for sweeping dust and foreign substances on the floor. The brush module 150 may be detachably coupled to the module mounting portion 110*a* in place of the mop module 120.

Accordingly, the user can selectively mount the mop module 120 or the brush module 150 on the module mounting portion 110*a* according to the purpose of cleaning. The controller may recognize a module mounted on the module mounting portion 110*a* and perform a corresponding operation.

For example, when the mop module 120 is mounted on the module mounting portion 110*a*, the controller may drive a rotation driving portion 110*b*. The mop module 120 which is connected to the rotation driving portion 110*b* then mops the floor while being rotated by an operation of the rotation driving portion 110*b*.

On the other hand, when the brush module 150 is mounted on the module mounting portion 110*a*, the controller may generate suction force for sucking air on the floor by driving a motor and a fan. In addition, the controller may control the brush module 150 connected to the rotation driving portion 110*b* to sweep dust and foreign substances on the floor, by driving the rotation driving portion 110*b*.

In this way, the controller controls the motor and the fan not to be driven in a state where the mop module 120 is mounted on the module mounting portion 110*a*.

The dust and foreign substances in the air sucked through the brush module 150 are filtered and collected in a dust container 170. The air separated from the dust and foreign substances is discharged to outside of the cleaner main body 110. The cleaner main body 110 is provided therein with an intake flow path (not illustrated) for guiding a flow of air from the brush module 150 to the dust container 170, and an exhaust flow path (not illustrated) for guiding a flow of air from the dust container 170 to the outside of the cleaner main body 110.

The dust container 170 may be provided with at least one of a filter and a cyclone for filtering the dust and foreign materials in the sucked air.

The cleaner 100 may include a dust container cover 180 covering the dust container 170. The dust container 170 may be prevented from being separated from the cleaner main body 110 by the dust container cover 180 when the dust container cover 180 is disposed to cover an upper surface of the dust container 170.

This drawing illustrates that the dust container cover 180 is hinged to the cleaner main body 110 to be rotatable. The dust container cover 180 may be fixed to the dust container 170 or the cleaner main body 110 to keep covering the upper surface of the dust container 170.

When the cleaner 100 has an autonomous travel function like the robot cleaner 100, the cleaner main body 110 may be provided with a sensing unit 190 for detecting a surrounding situation. The controller may sense an obstacle, detect a land feature, or generate a map of a travel area through the sensing unit 190.

Hereinafter, the mop module 120 detachably coupled to the cleaner 100 will be described in more detail.

Figure 4:
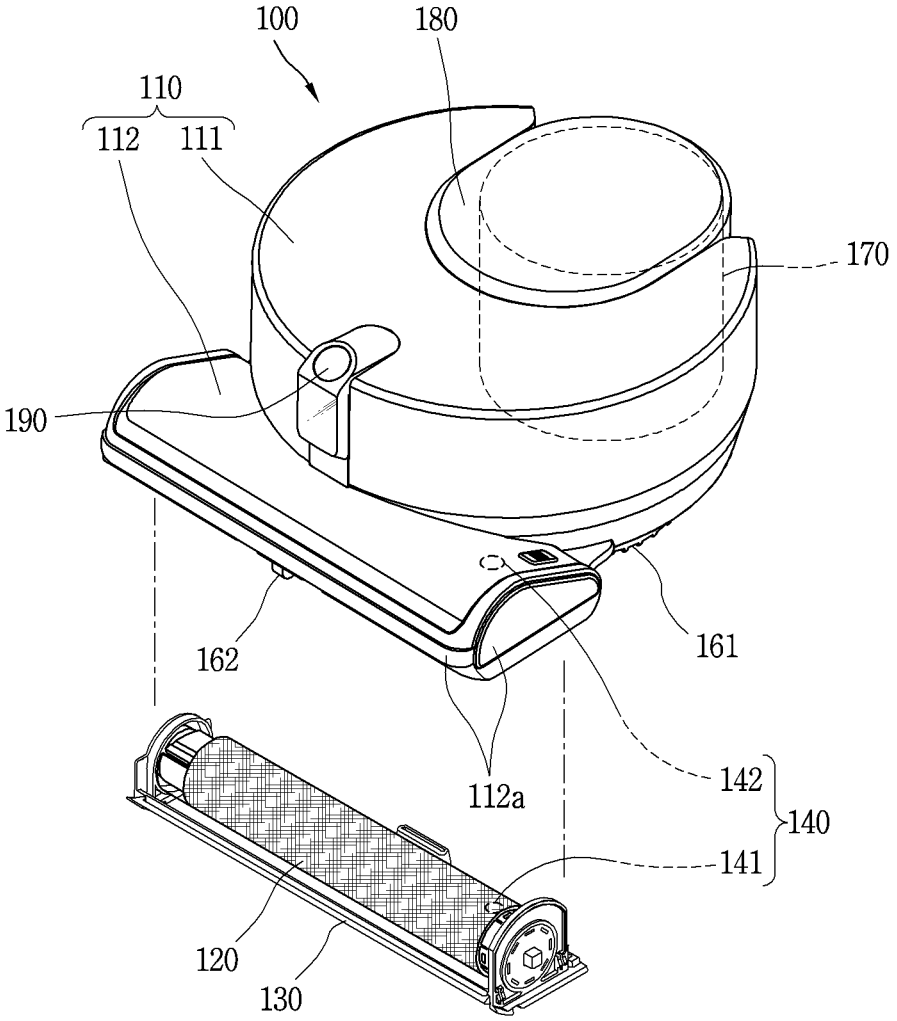
FIG. 4 is a conceptual view illustrating a support member and a mop module rotatably coupled to the support member, detached from the cleaner main body illustrated in FIG. 1.
Figure 5:
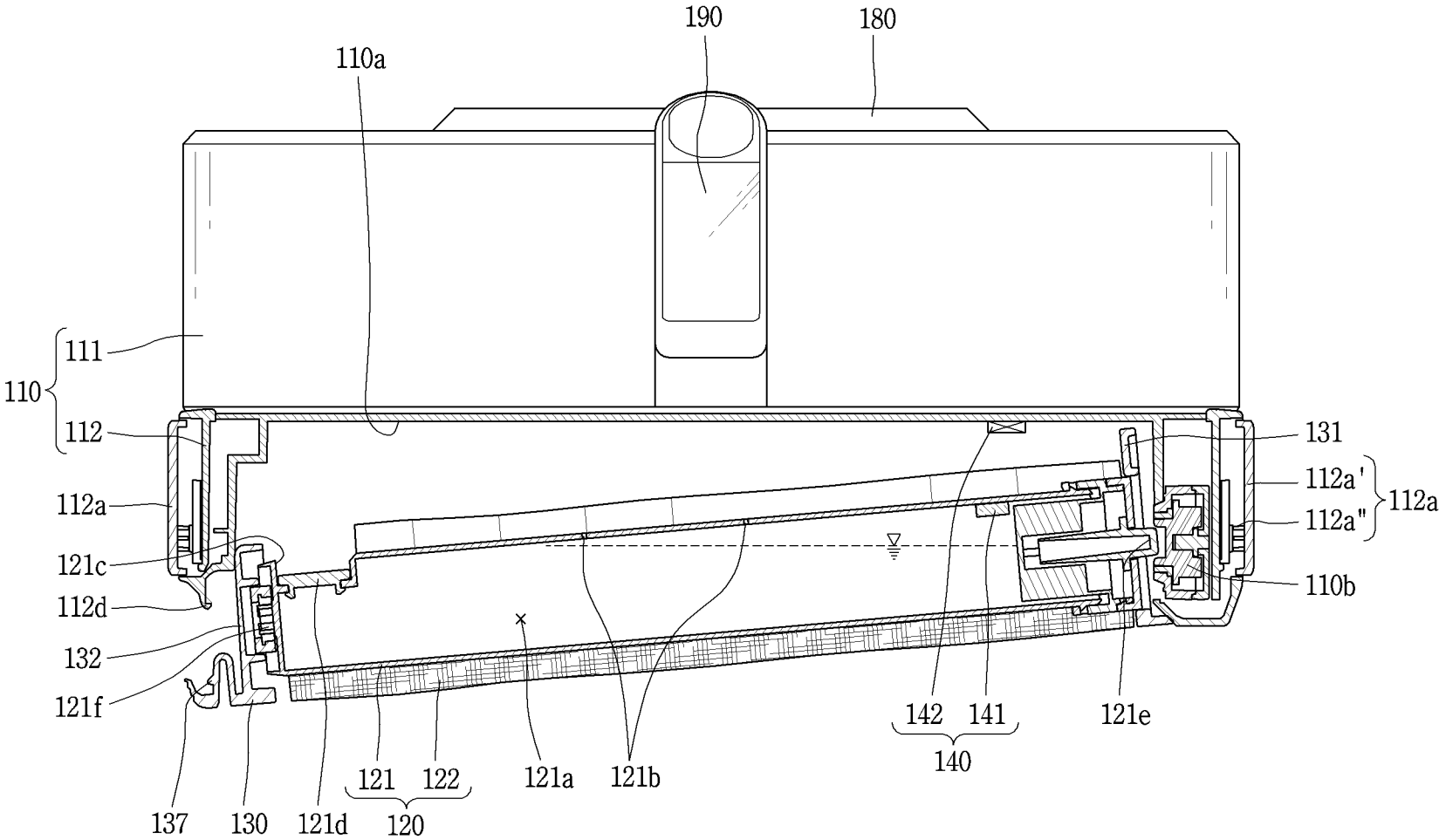
FIG. 5 is a view illustrating a state in which a mop module is mounted on the cleaner main body illustrated in FIG. 4.

FIG. 4 is a conceptual view illustrating a support member 130 and the mop module 120 rotatably coupled to the support member 130, detached from the cleaner main body 110 illustrated in FIG. 1. FIG. 5 is a view illustrating a state in which the mop module 120 is mounted on the cleaner main body 110 illustrated in FIG. 4, and FIG. 6 is a conceptual view illustrating the support member 130 and the mop module 120 illustrated in FIG. 4 in a detached state.

Figure 6:
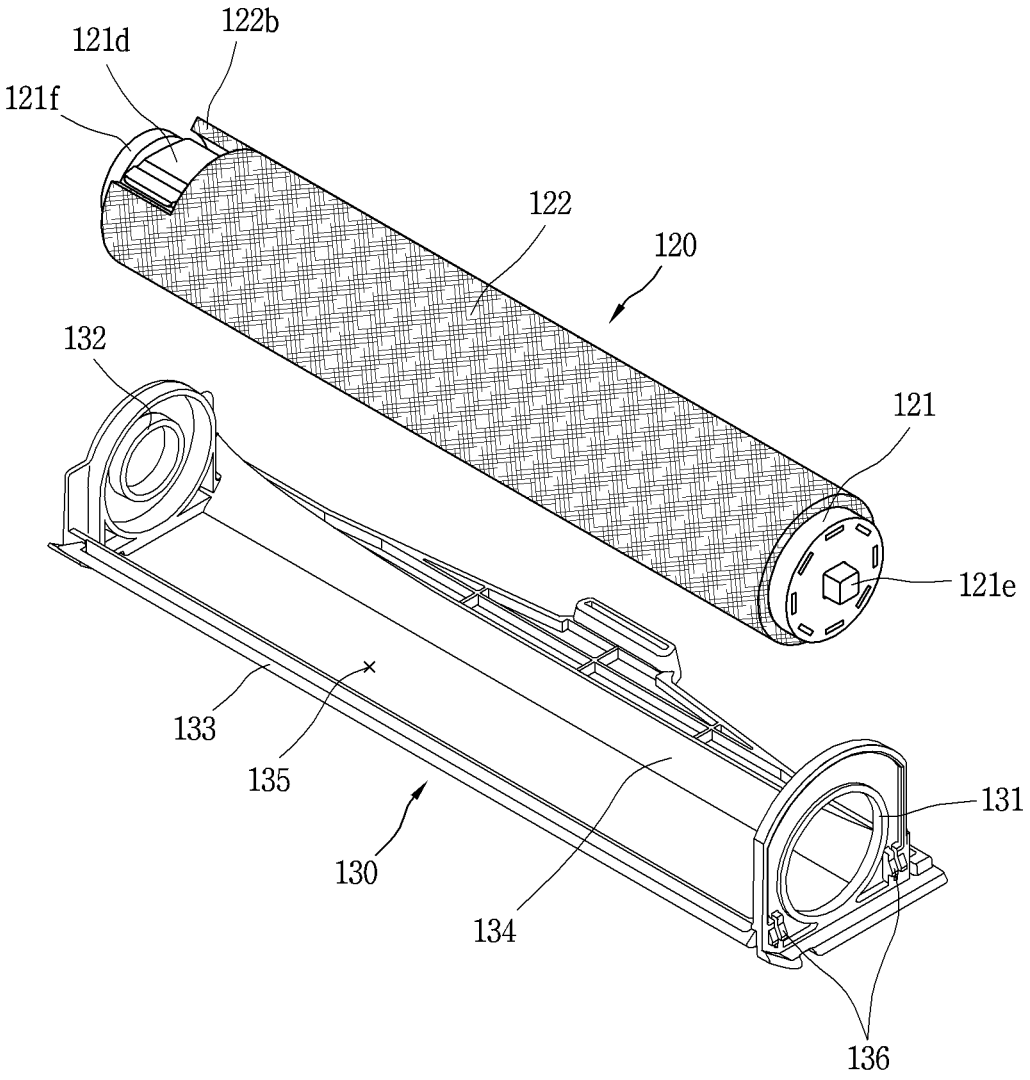
FIG. 6 is a conceptual view illustrating the support member and the mop module illustrated in FIG. 4.

Referring to FIGS. 4 to 6, the mop module 120 is detachably coupled to the module mounting portion 110*a* of the cleaner main body 110. In these drawings, the module mounting portion 110*a* is formed on the lower portion of the module mounting housing 112 coupled to the main housing 111 in a protruding manner.

However, the present invention is not limited thereto. The cleaner main body 110 may be configured only by the main housing 111. In this case, the module mounting portion 110*a* may alternatively be formed on the lower portion of the main housing 111. That is, the mop module 120 may also be detachably coupled to the main housing 111.

The mop module 120 may be detachably coupled to the cleaner main body 110 in a state of being rotatably coupled to the support member 130.

The support member 130 is configured to rotatably support the mop module 120. On both end portions of the support member 130 may be provided a first support portion 131 and a second support portion 132 for rotatably supporting both of the end portions of the mop module 120.

The first support portion 131 and the second support portion 132 may be connected by a first connection portion 133 and a second connection portion 134 which are spaced apart from each other in a back and forth direction. The mop module 120 coupled to the first and second supporting portions 131 and 132 may partially protrude into a space 135 formed between the first and second connection portions 133 and 134.

The support member 130 is detachably coupled to the module mounting portion 110*a* of the cleaner main body 110. For this coupling, the support member 130 may be provided with a hook that is configured to be locked in the module mounting portion 110*a*. For example, a first hook 136 and a second hook 137, which are locked respectively by a first locking protrusion 112*c* (see FIG. 9) and a second locking protrusion 112*d* formed on both sides of the module mounting portion 110*a*, may be provided on both end portions of the support member 130. Here, at least one of the first or second hooks 136 and 137 may be configured to be elastically deformable so as to be unlocked.

Hereinafter, description will be given of a structure in which the support member 130 is detachably coupled to the cleaner main body 110 while rotatably supporting the mop module 120, but the present invention is not limited thereto. The mop module 120 may alternatively be detachably coupled directly to the cleaner main body 110 without the support member 130. In this case, the module mounting portion 110*a* of the cleaner main body 110 may be provided with a component corresponding to the support member 130.

When the mop module 120 is mounted on the module mounting portion 110*a* while being rotatably supported by the support member 130, the mop module 120 is connected to the rotation driving portion 110*b*. Accordingly, when the rotation driving portion 110*b* is driven, the mop module 120 is rotatable accordingly. Therefore, the mop cleaning function can be implemented not only by the movement of the cleaner main body 110 but also by the rotation of the mop module 120. This may result in improving mopping performance as compared with a mopping method of the related art cleaner.

Figure 7:
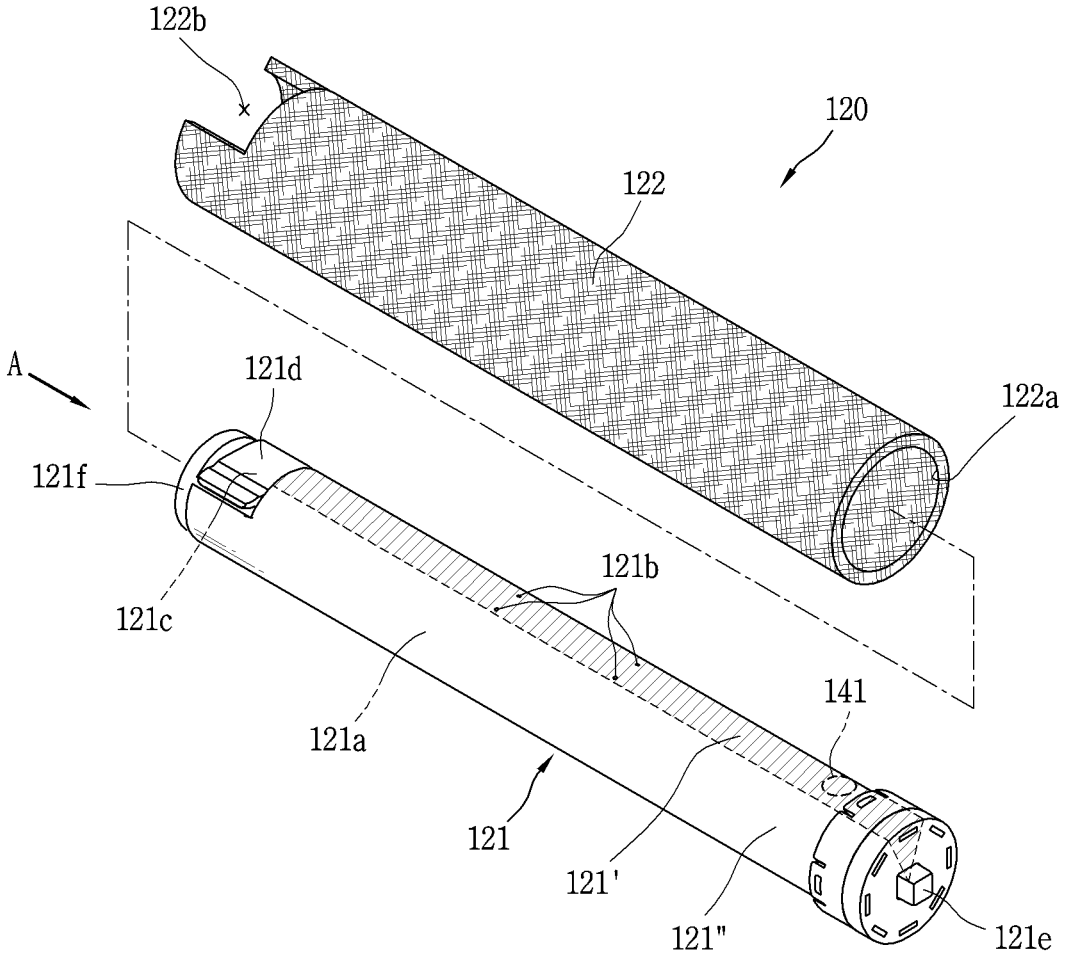
FIG. 7 is an exploded perspective view of the mop module illustrated in FIG. 6.
Figure 8:
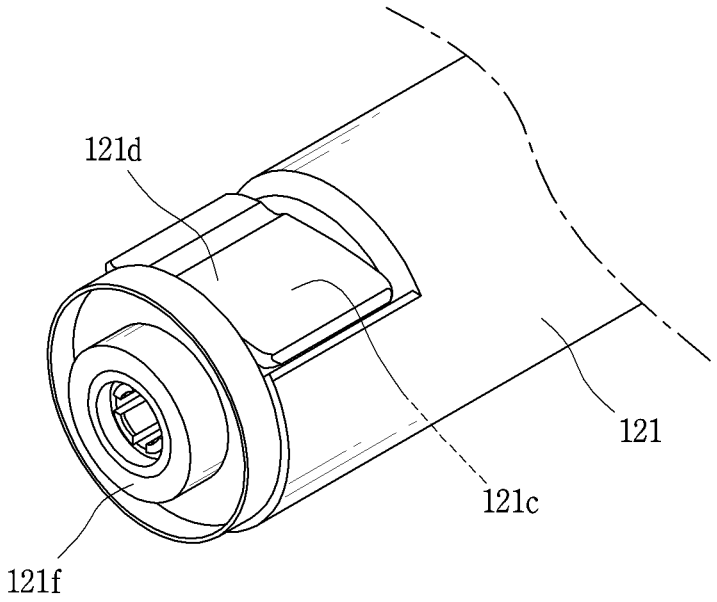
FIG. 8 is a view of a rotating rod illustrated in FIG. 7, viewed from a direction A.
Figure 9:
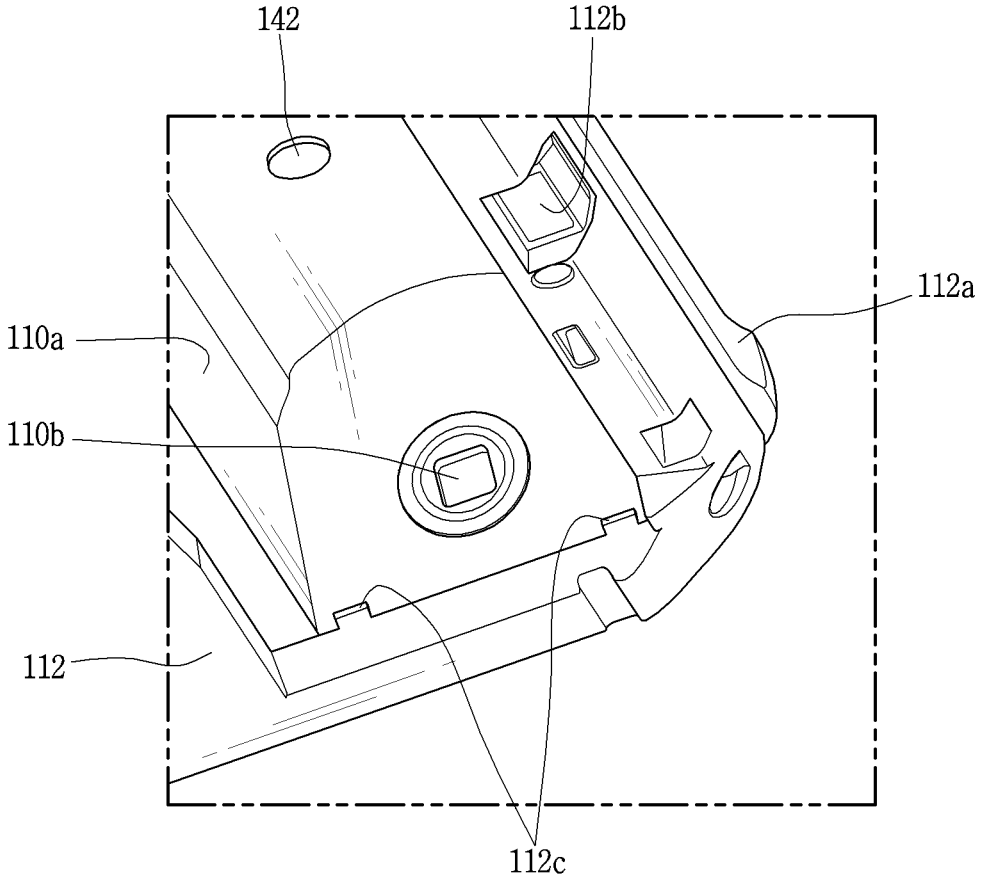
FIG. 9 is a view illustrating a module mounting portion of the cleaner main body, to which one end portion of the mop module illustrated in FIG. 6 is rotatably mounted.
Figure 10:
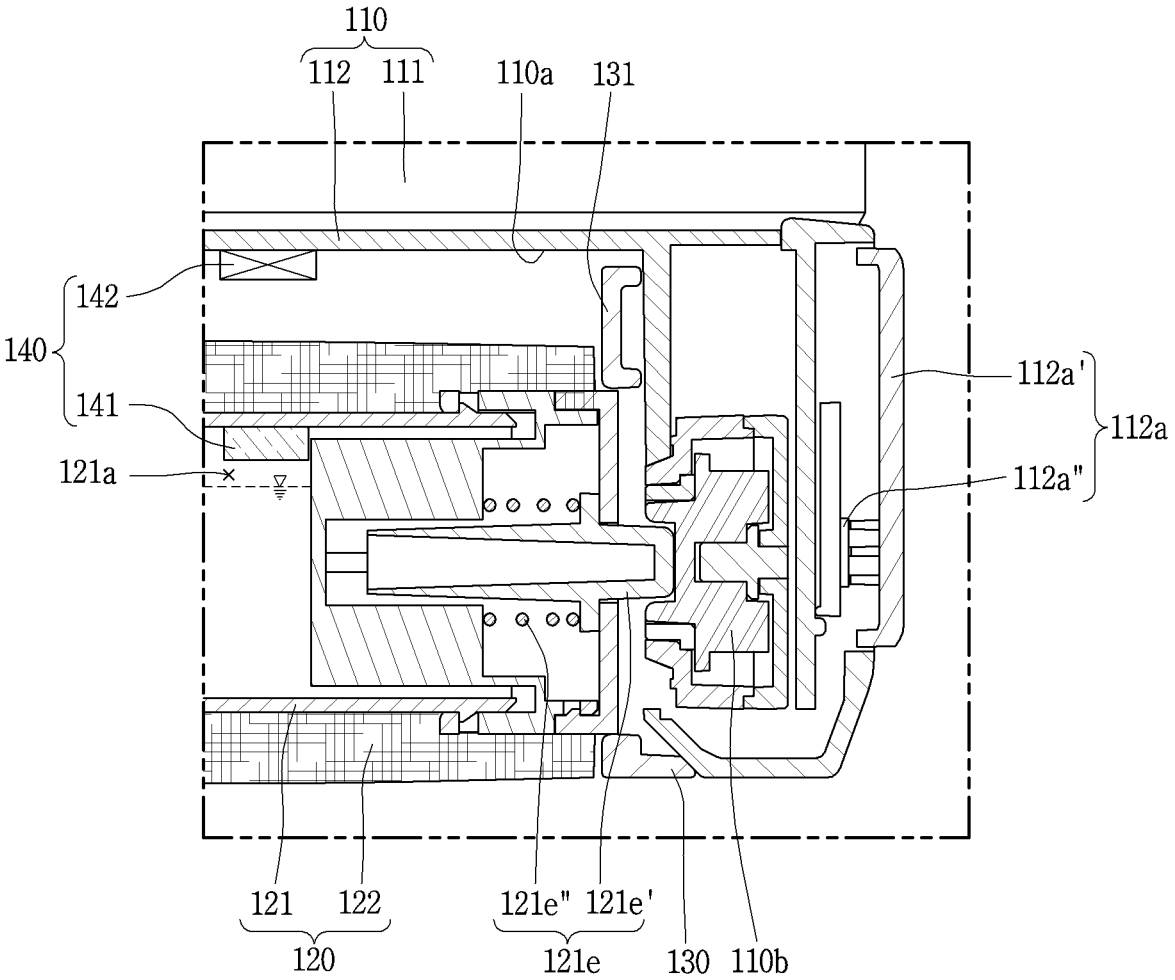
FIG. 10 is a sectional view taken along a line B-B illustrated in FIG. 1.
Figure 11:
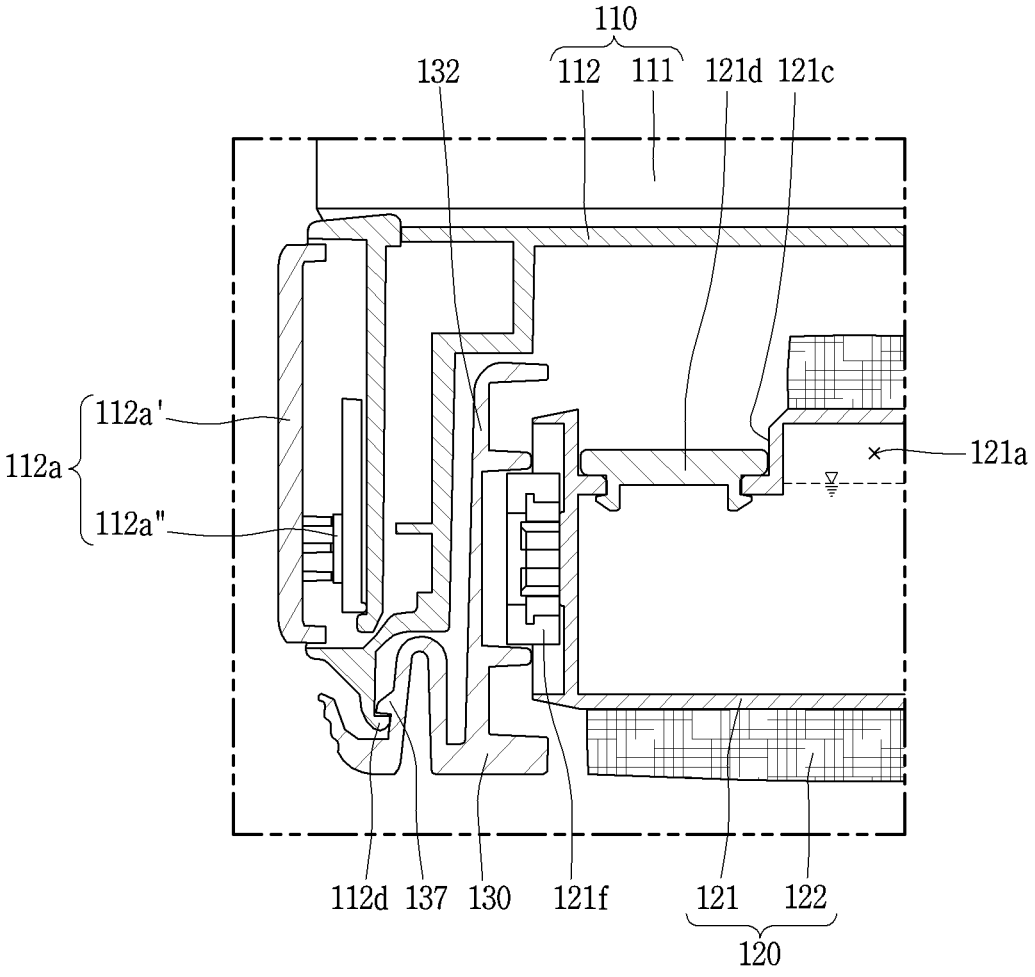
FIG. 11 is a sectional view taken along a line C-C illustrated in FIG. 1.

FIG. 7 is an exploded perspective view of the mop module 120 illustrated in FIG. 6, and FIG. 8 is a view of a rotating rod 121 of FIG. 7, taken along a line A. Also, FIG. 9 is a view illustrating the module mounting portion 110*a* of the cleaner main body 110 to which one end portion of the mop module 120 illustrated in FIG. 6 is rotatably mounted. FIG. 10 is a sectional view taken along a line B-B illustrated in FIG. 1, and FIG. 11 is a sectional view taken along a line C-C illustrated in FIG. 1.

Referring to these drawings, the mop module 120 includes a rotating rod 121 and a mop member (or mop cover) 122.

The rotating rod 121 extends long in one direction. The rotating rod 121 may be disposed perpendicular to a forward traveling direction of the cleaner main body 110. The rotating rod 121 is connected to the rotation driving portion 110*b* when mounted on the cleaner main body 110, so as to be rotatable in at least one direction.

A rotation coupling portion 121*e* coupled to the rotation driving portion 110*b* is provided on one end of the rotating rod 121. The rotation coupling portion 121*e* is coupled to the rotation driving portion 110*b*, and rotates the rotating rod 121 by receiving rotational force from the rotation driving portion 110*b* upon driving the rotation driving portion 110*b*.

The rotation coupling portion 121*e* may include a coupling member 121*e*' and an elastic member 121*e*".

The coupling member 121*e*' is formed to penetrate through one end portion of the rotating rod 121. The coupling member 121*e*' partially protrudes from the one end portion of the rotating rod 121, and at least part of the coupling member 121*e*' may be drawn into the rotating rod 121 by being pressed.

The elastic member 121*e*" is configured to elastically press the coupling member 121*e*' in a direction protruding from the one end portion of the rotating rod 121. The elastic member 121*e*" may be interposed between an inner structure of the rotating rod 121 and a flange portion of the coupling member 121*e*'.

With this structure, when an end portion of the rotation coupling portion 121*e* is pressed into the rotating rod 121, at least part of the rotation coupling portion 121*e* may be drawn into the one end portion of the rotating rod 121. Further, when the pressing is released, the at least part of the rotation coupling portion 121*e* may be drawn out of the one end portion of the rotating rod 121 again.

The rotation driving portion 110*b* may be provided on one side of the module mounting portion 110*a*. The rotation driving portion 110*b* is configured to be rotatable by an operation of a motor. Therefore, when the rotation driving portion 110*b* is driven in a state where the rotation coupling portion 121*e* of the mop module 120 is coupled to the rotation driving portion 110*b*, the rotational force may be transmitted to the mop module 120.

A rotation support portion 121*f* for rotatably supporting the rotating rod 121 is provided on another end portion of the rotating rod 121. The rotation support portion 121*f* may include a bearing. When the rotation coupling portion 121*e* is coupled to the rotation driving portion 110*b* by the rotation support portion 121*f*, an axis of the rotating rod 121 may be positioned to coincide with an axis of the rotation driving portion 110*b*.

As described above, the rotating rod 121 may be rotatably mounted on the support member 130. In these drawings, the first support portion 131 is provided with a through hole through which the rotating rod 121 is inserted, and the rotation coupling portion 121*e* protrudes from the one end portion of the rotating rod 121 which outwardly protrudes through the through hole. The second support portion 132 is configured to rotatably support the rotation support portion 121*f* provided on the another end portion of the rotating rod 121.

For example, when the rotating rod 121 has the structure of being mounted directly on the module mounting portion 110*a* without the support member 130, the rotation support portion 121*f* for rotatably supporting the rotating rod 121 may be formed on another side of the module mounting portion 110*a*.

A water receiving portion (or liquid receiving cavity) 121*a* is formed inside the rotating rod 121. The rotating rod 121 is provided with a water inlet 121*c* communicating with the water receiving portion 121*a*. When desiring to refill water inside the rotating rod 121, the user can open a stopper 121*d* of the water inlet 121*c* to inject water into the water receiving portion 121*a*.

A water outlet 121*b* communicating with the water receiving portion 121*a* is formed through an outer circumference of the rotating rod 121. The water filled in the water receiving portion 121*a* is discharged through the water outlet 121*b*.

The water outlet 121*b* may be provided in plurality which may be arranged with being spaced apart from each other by predetermined intervals. In these drawings, the water outlets 121*b* are arranged with being spaced apart from each other by the predetermined intervals along a lengthwise direction and a circumferential direction of the rotating rod 121.

The water outlet 121*b* may alternatively extend long along the lengthwise direction of the rotating rod 121.

As described above, the mop module 120 is mounted on the module mounting portion 110*a*, and is configured to be rotatable according to the operation of the rotation driving portion 110*b*. Accordingly, centrifugal force is applied to the rotating rod 121 upon the rotation of the mop module 120.

By using this feature, the water outlet 121*b* may have a preset size so that water filled in the water receiving portion 121*a* is discharged through the water outlet 121*b* by the centrifugal force only when the mop module 120 rotates. That is, when the mop module 120 is not rotated, water may not be discharged through the water outlet 121*b*.

The mop member 122 is formed so as to surround the outer circumference of the rotating rod 121. The mop member 122 may be configured not to cover a portion of the rotating rod 121 corresponding to the water inlet 121*c*. In these drawings, the mop member 122 is provided with a cutout portion 122*b* corresponding to the stopper 121*d*.

The water inlet 121*c* is configured to be externally exposed without being covered with the mop member 122. Accordingly, when water refill is needed, the stopper 121*d* of the water inlet 121*c* is open to inject water even without separating the mop member 122 from the rotating rod 121.

The mop member 122, as illustrated, may be provided with a hollow portion 122*a* corresponding to the rotating rod 121, and may be formed in a cylindrical shape with both ends open in the lengthwise direction. Alternatively, the mop member may be wound on the outer circumference of the rotating rod 121 and thereafter both ends thereof may be adhered by velcro.

The mop member 122 is disposed to cover the water outlet 121*b* so that the water discharged from the water outlet 121*b* can wet the mop member 122.

The mop member 122 may be formed of a soft fabric material, and, if necessary, may have a shape in which a soft fabric portion is provided on a hard base portion for shape maintenance. In this case, the base portion is configured to surround the outer circumference of the rotating rod 121, and allows water discharged from the water outlet 121*b* to be permeable therein.

In the above structure, the rotating rod 121 may be divided into a first part 121' with the water outlet 121*b* disposed in the circumferential direction, and a second part 121" without the water outlet 121*b*. The first part 121' preferably occupies a rate less than a half of the entire circumference of the rotating rod 121.

The controller may be configured to stop the operation of the rotating rod 121 using the sensing unit 140 in a state where the first part 121' is positioned above the second part 121". According to this, in a state in which the rotation of the rotating rod 121 is stopped, the water outlet 121*b* is always arranged to face an upper side of the rotating rod 121. Accordingly, when the cleaner 100 is turned off, water is not discharged through the water outlet 121*b*. As a result, it is possible to solve the problem of wetting the floor due to water leakage even while the cleaner is turned off, which has occurred in the related art cleaner.

The sensing unit 190 may be configured to sense a rotating state of the rotating rod 121 using a hall effect. For this, the sensing unit 190 includes a permanent magnet 141 and a hall sensor 142.

The permanent magnet 141 is mounted on the rotating rod 121. Therefore, a change in magnetic force by the permanent magnet 141 occurs when the rotating rod 121 rotates. For example, the permanent magnet 141 may be mounted on the first part 121' of the rotating rod 121.

The hall sensor 142 is installed in the cleaner main body 110 to detect the change in the magnetic force caused by the permanent magnet 141. As illustrated in FIG. 9, the hall sensor 142 may be installed on an upper side of the module mounting portion 110*a*.

As illustrated in FIG. 10, the permanent magnet 141 may be arranged to face the hall sensor 142 in a state where the rotation of the rotating rod 121 is stopped. To this end, the controller may control the operation of the rotation driving portion 110*b* so that the rotating rod 121 is stopped in the arranged state.

In addition, the water inlet 121*c* may be formed at the first part 121'. In this manner, in case where both of the water inlet 121*c* and the water outlet 121*b* are formed at the first part 121', when the user desires to refill water into the rotating rod 121, the problem of water leakage through the water outlet 121*b* is not caused because the water outlet 121*b* is arranged to face the same direction (the upper side) as the water inlet 121*c*.

Figure 12:
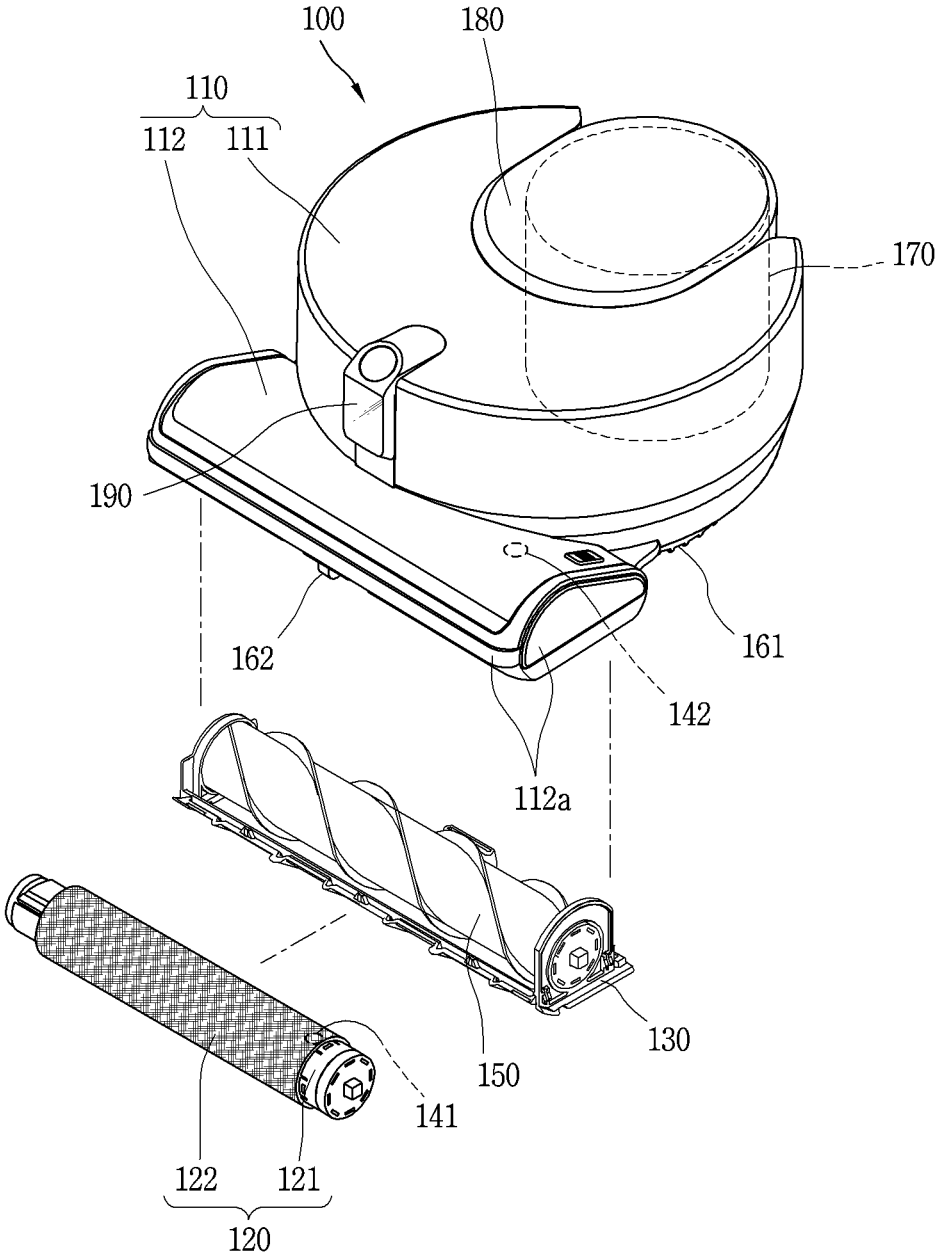
FIG. 12 is a view illustrating a concept that a brush module is mounted in place of the mop module illustrated in FIG. 4.

FIG. 12 is a view illustrating a concept of replacing the mop module 120 illustrated in FIG. 4 with the brush module 150.

As illustrated in FIG. 12, in a state where the mop module 120 is detached from the module mounting portion 110*a*, the brush module 150 may be mounted on the module mounting portion 110*a*. The permanent magnet 141 may not be attached to the brush module 150.

Therefore, unlike the case where the mop module 120 is mounted, the magnetic force is not sensed through the hall sensor 142 when the brush module 150 is mounted.

The controller may detect whether the mop module 120 is mounted on the module mounting portion 110*a* or the brush module 150 is mounted on the module mounting portion 110*a*, based on whether or not the magnetic force is detected using the hall sensor 142. In addition, the controller may activate a different cleaning mode depending on the detection or non-detection of the magnetic force using the hall sensor 142.

For example, when the brush module 150 is mounted on the module mounting portion 110*a*, the controller may generate suction force for sucking air on the floor by driving the motor and the fan. In addition, the controller may drive the rotation driving portion 110*b* such that the brush module 150 connected to the rotation driving portion 110*b* sweeps dust and foreign substances from the floor.

On the other hand, when the mop module 120 is mounted on the module mounting portion 110*a*, the controller may drive the rotation driving portion 110*b*. The mop module 120 which is connected to the rotation driving portion 110*b* mops the floor while being rotated by the operation of the rotation driving portion 110*b*.

As described above, the controller may be configured to drive the motor, the fan, and the rotation driving portion 110*b* in the state where the brush module 150 is mounted on the module mounting portion 110*a*. On the other hand, in the state where the mop module 120 is mounted on the module mounting portion 110*a*, the controller may drive only the rotation driving portion 110*b* without driving the motor and the fan.

The foregoing description has been given exemplarily of the robot cleaner, to which the present invention is applied. The robot cleaner is merely illustrative to help understanding the example to which the present invention is applied, but it should not be construed that the present invention is applied only to the robot cleaner.

That is, the above-described structure may be applied to all types of cleaners such as a canister type, an upright type, and the like.

What is claimed is:

1. A cleaner, comprising:

a cleaner main body having a controller;

a support frame detachably coupled to a module mounting recess of the cleaner main body; and a mop module rotatably supported on the support frame, wherein the mop module comprises:

a rotating rod configured to be rotatable in at least one direction by being interlocked with a rotation driving portion provided in the module mounting recess when the support frame is mounted on the module mounting recess; and a mop cover formed to surround an outer circumference surface of the rotating rod so as to mop the floor in response to the rotation of the rotating rod, wherein the cleaner further includes a sensing unit configured to detect rotational position of the rotating rod, wherein the rotating rod includes a liquid receiving cavity formed therein, wherein a liquid outlet communicating with the liquid receiving cavity is formed through the outer circumference surface of the rotating rod, wherein the outer circumference surface of the rotating rod is divided into a first region that includes the liquid outlet and a second region that does not include the liquid outlet, and wherein the controller stops the rotation of the rotating rod at a particular rotational position, as detected by the sensing unit, at which the first region of the outer circumference surface of the rotating rod is positioned above the second region.

2. The cleaner of claim 1, wherein the liquid outlet has a preset size such that water filled in the liquid receiving cavity is discharged through the liquid outlet by centrifugal force only when the rotating rod rotates.

3. The cleaner of claim 1, wherein the sensing unit comprises:

a permanent magnet mounted on the rotating rod; and a hall sensor installed on the module mounting recess to detect a change in magnetic force caused by the permanent magnet.

4. The cleaner of claim 3, wherein a brush module is capable of being detachably coupled to the module mounting portion in place of the mop module, the brush module being configured to sweep dust on the floor but not provided with a permanent magnet, wherein the controller selects between different cleaning modes depending on whether a magnetic force is detected by the hall sensor, and wherein the different cleaning modes include:

a vacuum cleaning mode in which the controller manages the cleaner to generate a suction force to vacuum the floor and drives the rotation driving portion when the brush module is mounted in the module mounting recess; and a mop cleaning mode in which the controller manages the cleaner to not generate the suction force and to drive the rotation driving portion when the mop module is mounted in the module mounting recess.

5. The cleaner of claim 1, wherein the liquid outlet is disposed to face upwards when the rotation of the rotating rod is stopped.

6. The cleaner of claim 5, wherein the first region is provided with a liquid inlet communicating with the liquid receiving cavity.

7. The cleaner of claim 6, wherein the mop cover is not provided over the liquid inlet.

8. The cleaner of claim 1, wherein the support frame comprises:

a first support portion and a second support portion to rotatably support both end portions of the rotating rod; and a first connection portion and a second connection portion arranged to be spaced apart from each other to connect the first support portion and the second support portion, and wherein a part of the mop module is disposed to protrude into a space between the first connection portion and the second connection portion spaced apart from each other.

9. The cleaner of claim 8, wherein a rotation coupling portion detachably coupled to the rotation driving portion is provided on one end portion of the rotating rod penetrating through the first support portion, and wherein a rotation support portion rotatably supported by the second support portion is provided on another end portion of the rotating rod.

10. The cleaner of claim 1, wherein the cleaner main body is provided with a driving wheel operated under the control of the controller.

11. The cleaner of claim 1, wherein the cleaner main body comprises:

a main housing having a circuit board constituting the controller mounted therein; and a module mounting housing coupled to the main housing in a protruding manner and having the module mounting recess formed thereon.

12. The cleaner of claim 1, wherein the rotation driving portion is configured to engage and rotate an end of the rotating rod.

13. A cleaner, comprising:

a cleaner main body having a controller and a module mounting recess; and a mop module detachably coupled to the cleaner main body, wherein the mop module comprises:

a rotating rod configured to be rotatable in at least one direction by being interlocked with a rotation driving portion provided in the module mounting recess upon being mounted on the cleaner main body, the rotating rod including a liquid receiving cavity therein, and a liquid outlet communicating with the liquid receiving cavity; and a mop cover provided to cover the liquid outlet and provided at an outer circumference surface of the rotating rod, to mop a floor in response to rotation of the rotating rod, and wherein the cleaner further includes a sensing unit configured to detect rotational position of the rotating rod, and wherein the controller is configured to stop the rotation of the rotating rod in a state where the liquid outlet is determined to be positioned above the liquid receiving cavity of the rotating rod by the sensing unit.

14. The cleaner of claim 13, wherein the sensing unit comprises:

a permanent magnet mounted on the rotating rod; and a hall sensor installed on the module mounting portion to detect a change in magnetic force caused by the permanent magnet.

15. The cleaner of claim 14, wherein a brush module is capable of being detachably coupled to the module mounting recess in place of the mop module, the brush module being configured to sweep dust on the floor but not provided with a permanent magnet, wherein the controller activates one of different cleaning modes depending on whether the magnetic force is detected by the hall sensor, and wherein the different cleaning modes include:

a vacuum cleaning mode in which the controller manages the cleaner to generate a suction force and drives the rotation driving portion when the brush module is mounted in the module mounting recess; and a mop cleaning mode in which the controller manages the cleaner to not generate the suction force and drives the rotation driving portion when the mop module is mounted in the module mounting recess.

16. The cleaner of claim 14, wherein the liquid outlet is disposed to face upwards when the rotation of the rotating rod is stopped.

17. The cleaner of claim 14, wherein the first region further includes a liquid inlet communicating with the liquid receiving cavity, the liquid inlet being configured to receive liquid to be provided to the liquid receiving cavity.

18. The cleaner of claim 17, wherein the mop cover is not provided over the liquid inlet.

19. The cleaner of claim 14, wherein the controller is configured to stop the rotation of the rotating rod in a position in which liquid is not outputted through the liquid outlet.

20. The cleaner of claim 13, wherein the cleaner main body includes:

a main housing having a circuit board constituting the controller mounted therein; and a module mounting housing coupled to the main housing in a protruding manner and having the module mounting recess formed thereon.

* * * * *